United States Patent [19]

Manriquez

[11] 4,227,819

[45] Oct. 14, 1980

[54] PRINTER PLATEN

[75] Inventor: Ralph F. Manriquez, San Jose, Calif.

[73] Assignee: International Computers Limited, London, England

[21] Appl. No.: 963,210

[22] Filed: Nov. 24, 1978

Related U.S. Application Data

[63] Continuation of Ser. No. 688,214, May 20, 1976, abandoned.

[51] Int. Cl.[2] ..... B41J 11/20

[52] U.S. Cl. ..... 400/56; 400/58; 400/649; 400/656

[58] Field of Search ..... 400/648; 649, 655, 656, 400/55-60

[56] References Cited

U.S. PATENT DOCUMENTS

| | | | |
|---|---|---|---|
| Re. 16977 | 5/1928 | Anthony | 400/56 |
| 388,366 | 3/1888 | Laass et al. | 101/234 |
| 3,463,084 | 8/1969 | Nineberg | 101/407 R |
| 3,837,461 | 9/1974 | Waibel | 400/56 |
| 3,995,730 | 12/1976 | Kwan et al. | 400/649 |
| 4,029,193 | 6/1977 | Kwan | 400/27 |
| 4,143,977 | 3/1979 | Kurihara et al. | 400/56 |

FOREIGN PATENT DOCUMENTS

| | | | |
|---|---|---|---|
| 1224696 | 3/1971 | United Kingdom | 101/93 |

OTHER PUBLICATIONS

Delapchier et al. "Passbook for Disc Printer" IBM Tech. Discl. Bulletin, vol. 13, No. 8, p. 2350, 1/71.

Vichich "Print Platen . . . "IBM Tech, Discl. Bulletin, vol. 16, No. 2, Jul. 73, p. 605.

Cole et al. "Springloaded Platen . . . " IBM Tech Discl Bulletin, vol. 20, No. 6 11/77 p. 2366.

*Primary Examiner*—William Pieprz

*Attorney, Agent, or Firm*—Hane, Roberts, Spiecens & Cohen

[57] ABSTRACT

A platen assembly for feeding and holding single or multi-layer record media (forms) for printing thereon, particularly useful in connection with a matrix type printer of a point-of-sale terminal. This assembly comprises one of a pair of feed rollers pivotally mounted so as to yieldingly engage and hold both sides of the record media, while a platen yieldingly engages and holds the record media against guides which determine the gap between the matrix head for proper operation of the printer wires. For line-by-line printing, the platen is first disengaged from the record media while the power feed rollers move the record media the required distance before the platen again engages the media. This platen assembly is particularly characterized by having the platen free-floating or mechanically disconnected from the rest of the assembly except through resilient means which permits the platen to assume an orientation commensurate with the orientation of the lower surface of the record media thus accommodating variations in thicknesses of the media, whether the variations in thickness are in the length of the media, such variations caused, for example, by a fold or crease in one of the layers.

3 Claims, 5 Drawing Figures

PRINTER PLATEN

This is a continuation of application Ser. No. 688,214 filed May 20, 1976, now abandoned.

BACKGROUND OF THE INVENTION

1. Field of Invention

This invention relates, in general, to mechanisms for finding and holding record media for properly printing thereon, preferably by a wire matrix type printer, and in particular, is related to a point-of-sale type data terminal having a wire matrix type printer and which must accommodate forms of the multi-layer type of various thicknesses, such as a bill-of-sale or sales order forms commonly used in retail sales.

2. Description of the Prior Art

The use of conventional wire matrix printers having a plurality of wires each individually actuated by a magnetic actuator, usually against a return spring, to impact a record medium to print a character; one wire printing one spot or dot of the character at a time, is old and well-known and the use of such wire matrix printers in point-of-sale terminals is also old and well-known, a typical example of which is discussed at length in the prior art U.S. Pat. No. to Waibel, 3,837,461, which issued Sept. 24, 1974, said patent having the same assignee as the present application.

The Waibel patent also disclosed a platen assembly for use in connection with such wire matrix printers which automatically accommodated either single or multiple layers of record media whose thicknesses varied and permitted various retailers to utilize different forms having one or more multiple copies for their own individual merchandising operation even though the number of layers and the layers themselves varied in thicknesses from retail outlet to retail outlet. The Waibel platen assembly automatically accommodated such forms, thus eliminating the necessity to customize each retail data terminal for each retailer.

While the platen assembly disclosed therein worked satisfactory under limited conditions, it has been found that an improvement was needed. First of all, while the platen accommodated forms of various thicknesses, it did not readily accommodate forms whose thicknesses may vary laterally, that is to say, may vary in thickness transverse the longitudinal axis of the forms, which transverse direction happens to be the same direction the matrix printer is printing. This variation can be caused by a number of things, such as either by a defect in the paper itself causing a non-uniform thickness of possibly in a fold in one of the layers.

Another need for improvement in the Waibel printer was in the cost of manufacture because of the large number of parts therein. Thus, there was a need not only to improve the performance of such a platen assembly, but also to reduce the cost, the latter being very important in the highly competitive business of point-of-sale terminals.

SUMMARY OF THE INVENTION

This invention, which solves the problems of the prior art devices and in particular is an improvement over the Waibel platen assembly, comprises a platen assembly in which the platen is free floating, that is to say, that the platen can accommodate variations in thicknesses of forms whether the variations are in length or transverse of the forms while the platen is being used to hold the forms during the printing operation. The platen being characterized by free floating means that the platen itself is mechanically disconnected except through resilient means which permits the platen to assume an orientation commensurate with the orientation of the lower surface of the media.

DESCRIPTION OF THE PREFERRED EMBODIMENT

To illustrate a data terminal in which the present invention may be used, a general description of such a terminal is set forth first.

Figure 1:
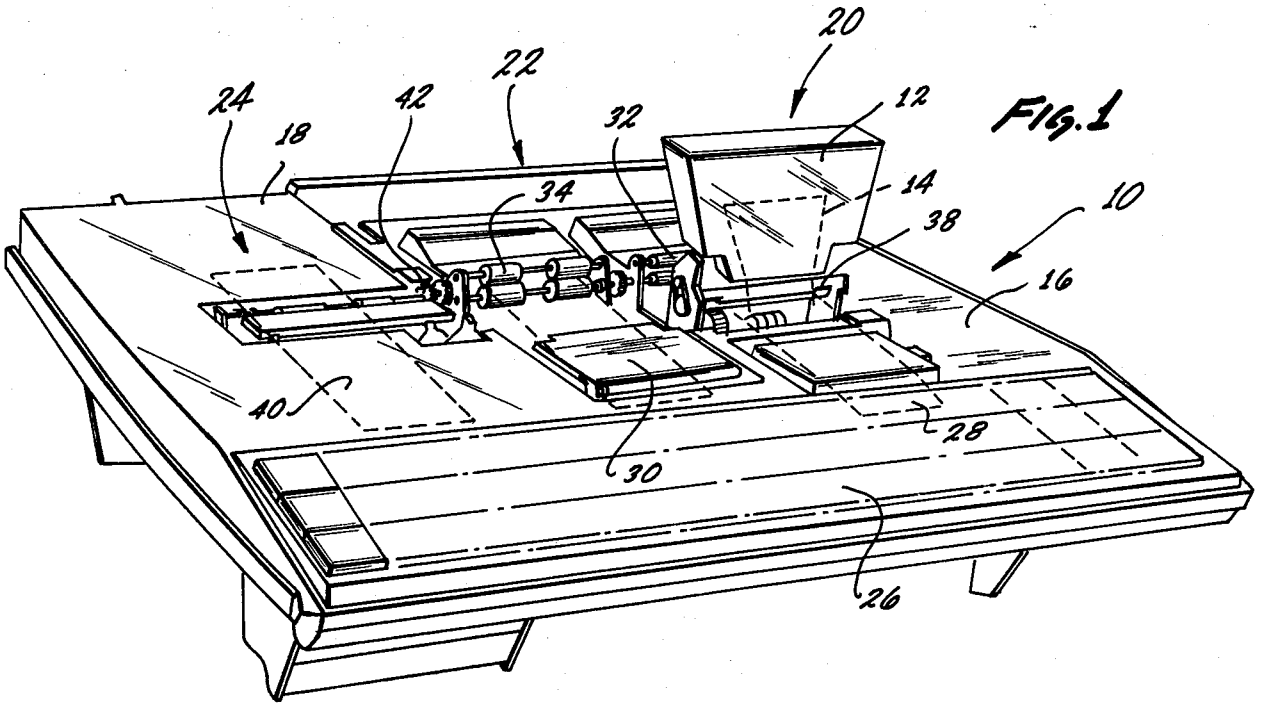
FIG. 1 is a perspective of a data terminal schematized and cut away to illustrate the relationship of the form printing station in which the platen assembly forming the present invention is incorporated and its cooperation with the rest of the data terminal including the matrix printer which prints on the forms handled by the present invention.

In FIG. 1 a data terminal 10 with the cover removed for the purposes of clarity, is shown as comprising, overall, a carriage 12, on which is mounted a suitable matrix print head 14 shown in phantom for clarity in depicting the other features of the terminal, movable laterally with respect to the frame 16, a work level surface 18 (partially shown), having three print stations 20, 22 and 24, and an appropriate keyboard 26. The three print stations 20, 22 and 24 are, respectively, a receipt station where the customer's receipt is printed (if a receipt is required), an audit station where the storekeeper's record (audit trail) of all transactions is printed, and a form station where the customer's order form or bill-of-sale is printed, if required.

By this arrangement, the carriage 12 and matrix print head 14 will not only move across the receipt and audit stations in pairs, but also across the form and audit stations in pairs, as well as traversing each of the stations individually so that appropriate rows and columns of data entered into the data terminal at the keyboard 26, or from a remote computer, is appropriately printed out.

In the embodiment shown, a receipt 28, if required, is printed in the receipt station 20 and the audit trail 30 is printed in the audit station 22 as the two record media are moved forward, i.e., in the direction of the keyboard 26 from a suitable supply, such as rolls of paper, by suitable roller feed mechanisms 32 and 34. These roller feed mechanisms are driven by a main drive shaft 36 (see FIG. 3) which is motor-operated and suitable clutch means are provided so as to directly connect the feed mechanisms to the shaft. The audit trail is rolled onto a spool, partially shown in FIG. 1, while a receipt 28 is severed by a suitable cutting mechanism 38, when a complete transaction is recorded. When the carriage 12 and print head are positioned to the left of that shown, a form 40, such as a customer order form or bill-of-sale, is printed in station 24 at the same time the audit trail is being printed. Also, the form station is provided with a pair of electronic sensing means which determine when a form is properly located in the form station, otherwise the terminal is inhibited from operating; suitable electronics being provided for this purpose. The form travels in a direction opposite from the direction of travel of the audit trail by suitable gearing 42 coupled to the main drive shaft 36 (FIG. 3), the latter moving the form and the audit trail or the audit trail and receipt, or the audit trail alone, as the case may be, to form rows and columns of data as determined by the input to the keyboard or from the remote computer.

The matrix print head 14 is capable of printing on the various media at the various stations and for the proper positioning of the rows and columns of characters on the record media, suitable strobe means and suitable electronics cooperating therewith are provided. For a more detailed description of the various elements so far described, reference is made to the U.S. Pat. No. 3,838,250 of Naas et al, supra, directed to the control for matrix printing assembly, U.S. Pat. No. 3,837,461 of Waibel, which shows one form of a print station for a matrix printer, and U.S. Pat. No. 3,834,638 of Savage et al, which shows one embodiment of an assembly for spooling the audit trail.

While the foregoing describes in general the operation of the various elements of the data terminal, no further description is deemed necessary herein, since this invention is directed specifically to the platen assembly to facilitate printing on the form 40 at the form station 24, which will now be described.

It should be noted at this time, however, that one of the many advantages of matrix printers in data terminals is the ability to print legibly through several copies of the forms but since various retailers decide which of a number of multi-layer forms are to be used, without a platen assembly such as described and claimed herein, it would be necessary to customize the data terminals to accommodate the selected number of layers of the forms. This platen assembly, however, provides an automatic compensation for forms of varying numbers of layers and thicknesses rendering such customization unnecessary. This particular invention herein disclosed, as mentioned supra, is an improvement over the platen assembly described and claimed in the U.S. Pat. No. 3,837,461 to Waibel, in that this invention not only compensates automatically for forms of various layers and thicknesses, it also compensates for any variation in thicknesses of or within the layers themselves.

Figure 2:
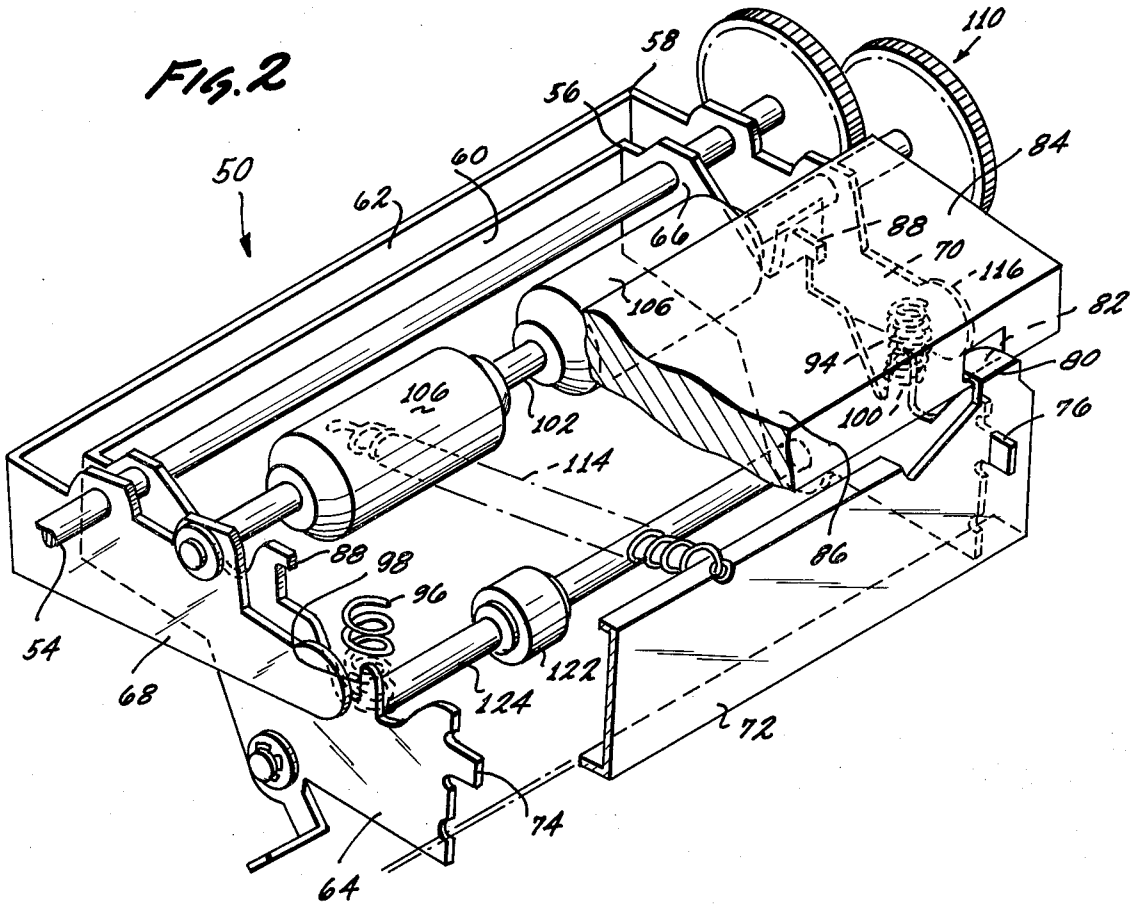
FIG. 2 is a perspective view, partially cut away and partially schematized, to show the platen assembly comprising the present invention out and away from the data terminal shown in FIG. 1.
Figure 3:
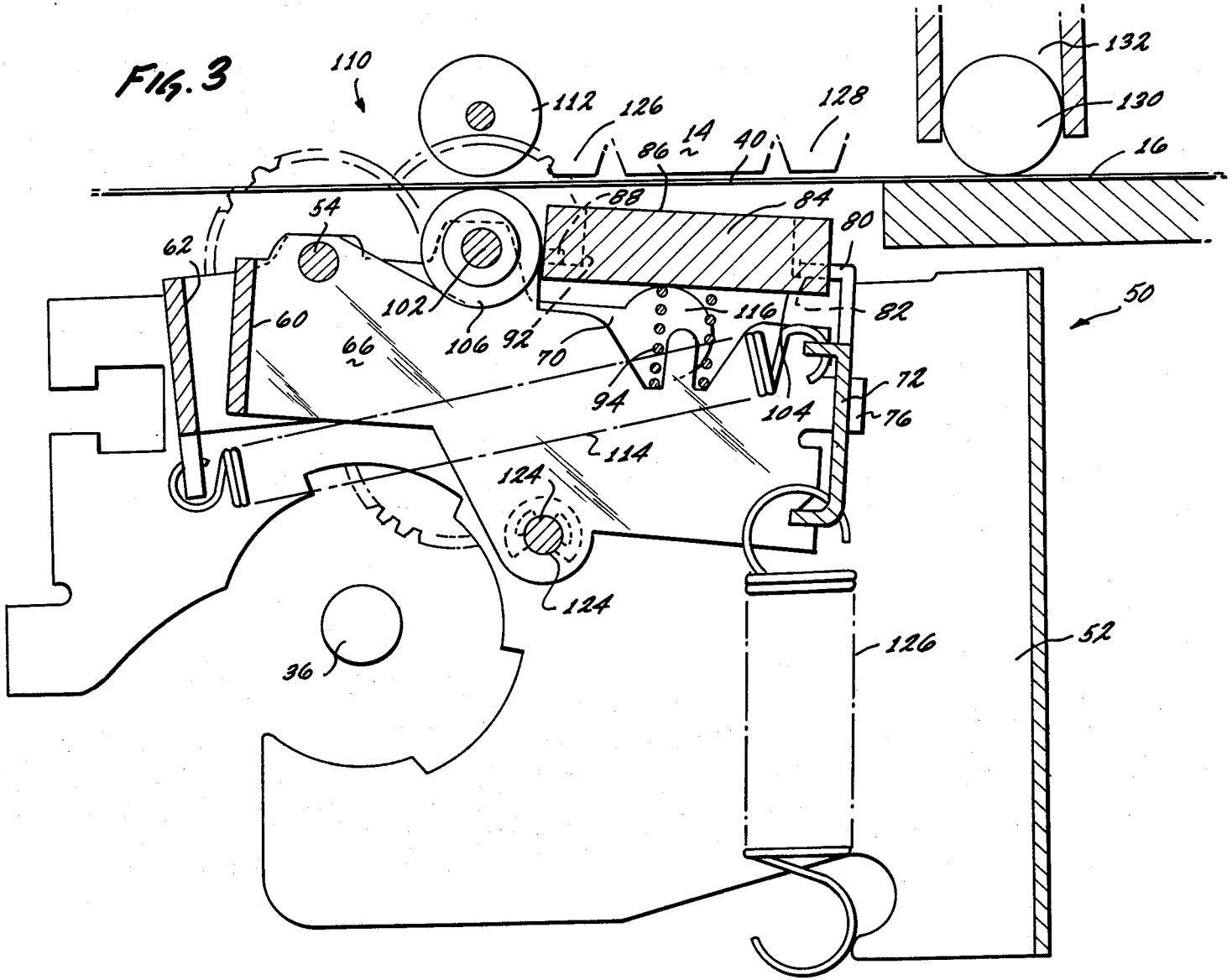
FIG. 3 is an enlarged elevational view partly in cross-section and enlarged with respect to FIGS. 1 and 2 to illustrate the working parts of the present invention and showing how the forms are inserted when the platen is in the form-inserting position.
Figure 4:
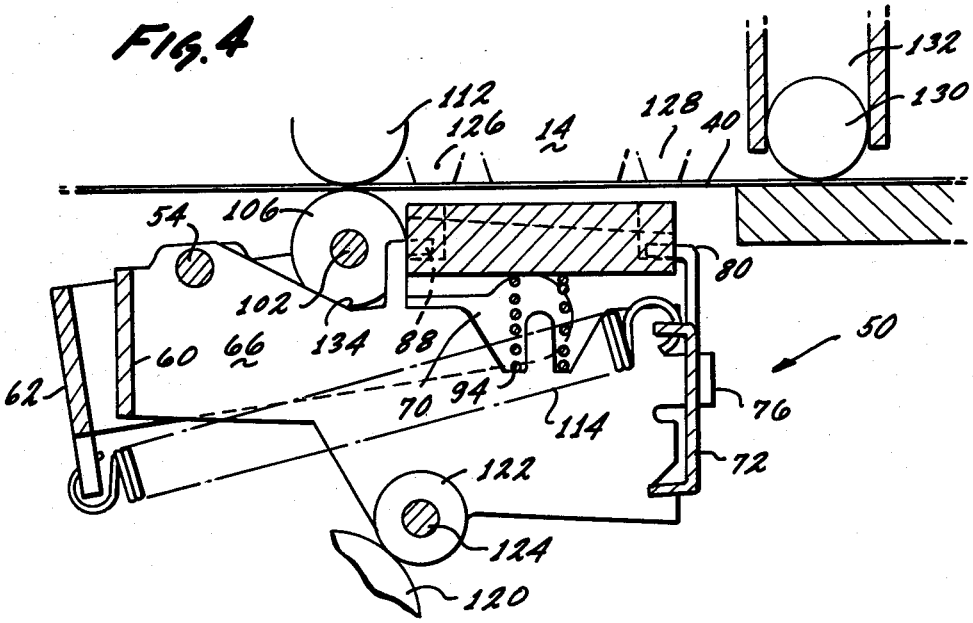
FIG. 4 is an elevational cross-sectional view of reduced size with respect to FIG. 3 but showing the platen in the form advance or intermediate position.
Figure 5:
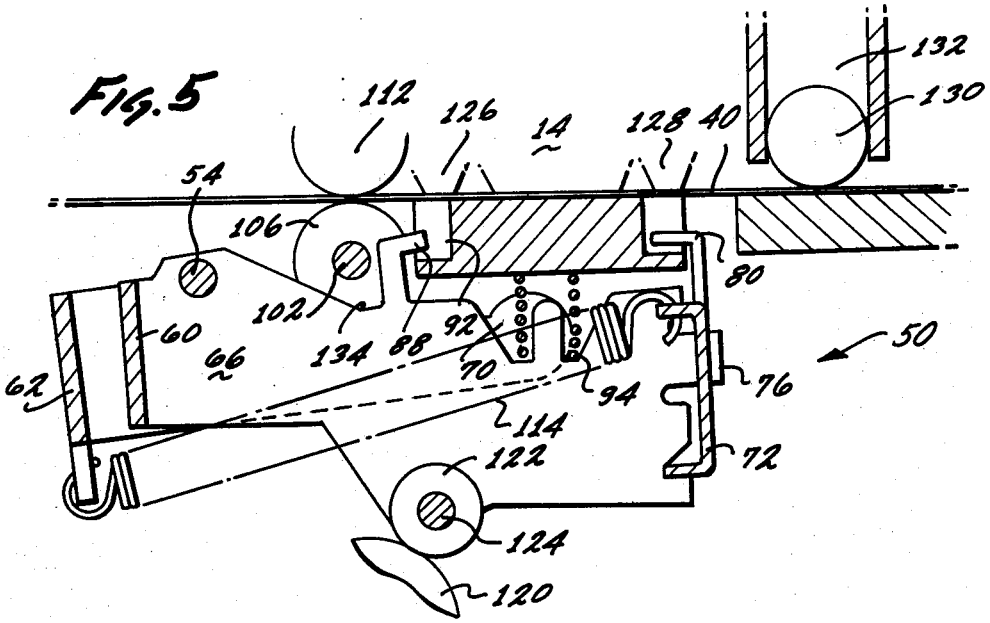
FIG. 5 is similar to FIG. 4 but showing the platen assembly in the form print position.

Turning now in more detail to the specific embodiment disclosed herein, it can be seen that FIG. 2 is a perspective view of the platen assembly 50 of the form station 24 and FIGS. 3, 4 and 5 illustrate various positions of the platen assembly 50 during a form feeding and printing operation.

As can be seen from a study of FIGS. 2 and 3, taken together, the platen assembly 50 is mounted within the data terminal between a pair of side frames (the left one shown FIG. 3 at 52) by shaft 54 which extends between the side frames through suitable apertures in a platen bail 56 and a roller bail 58 (FIG. 2) to pivotally mount the two bails thereon.

The platen bail 56 is located within the roller bail 58 and spaced slightly therefrom, sufficient to prevent interference between the two during pivotal action on the shaft 54, and, being U-shaped, is provided with a back wall 60 which is, of course, shorter than the back wall 62 of the roller bail and is further provided with arms 64 and 66 which are longer than the arms 68 and 70 of the roller bail. The length relationship of the respective arms is clearly discernible in FIG. 2.

The arms 64 and 66 of the platen bail are further provided with an end plate 72 which is affixed to the arms 64, 66 by any suitable means; the tabs 74 and 76 extending through suitable slots in the end plate and slightly bent after assembly form one such means. The end plate 72 is also provided with a pair of hooks 80 (one only shown), each near the upper edges of the end plate which engage a pair of ledges 82 (again only one shown), located on the outside edge and near the ends of platen 84 but below the printing surface 86 thereof. This pair of hooks 80 cooperate with a second pair of hooks 88 formed on the arms 64 and 66 of the platen bail and which engage similar ledges 92 (only one shown in FIG. 3), also located below the printing surface 86 of the platen but on the opposite edge of the other ledges 82. These ledges 82 and 92 are formed in the platen in such a manner that the platen is free to move downwardly relative to the hooks, but the hooks are held against the ledges by a pair of coil springs 94, 96 positioned on the platen bail arms by a pair of spring guides 98, 100 formed on the upper edges of the arms but between the pairs of hooks so as to position the springs so they engage the bottom surface 104 of the platen between the hooks and ledges.

Turning now to the roller bail 58 which, of course, is also pivoted on shaft 54, it can be seen that the arms 68 and 70 of the roller bail are also provided with a roller shaft 102 extending therebetween. This roller shaft 102 has a pair of rotatable driving friction-type rollers 106 which, of course, moves with the roller bail and are driven by a suitable gearing system, indicated in its entirety as 110, connected to a main drive shaft 36 of the terminal. These driving rollers at the appropriate time engage stationary but freely rotatable friction-type rollers 112 (only one shown in FIG. 3) which are frictionally driven by the driving rollers acting through the forms 40 inserted therebetween.

The platen bail 56 and the roller bail 58 are resiliently held together so as to move partly in unison and partly independently of one another during the operation of the platen assembly by a coil spring 114 attached near the lower edge of the roller bail back wall 62 and to the front plate 72 of the platen bail. While the bias of the coil spring 114 tends to urge the two bails into rotational movement relative to one another, the outer ends of the arms 68 and 70 of the roller bail are provided with small curved abutments or stop means 116 and 118 which engage the bottom side 104 of the platen and serve to limit the upeard travel of the roller bail. Were it not for these stop means, the bias of the coil spring 114 would rotate the roller bail about the shaft much too far. On the other hand, the platen is free to move further upwardly independently of the roller bail in response to upwardly directed force imposed on the platen bail by the rotation of a cam 120 (FIGS. 4 and 5) mounted on the main drive shaft 36 which engages a cam follower 122 (see also FIG. 2) mounted on a shaft 124. The shaft 124 is, in turn, journalled in the lower portions of the arms 64 and 65 of the platen bail. Camming surfaces on the rotatable cam 120, acting through the cam follower 122, urge both bails upwardly against the bias of a return spring 126, connected to the platen bail and to any suitable portion of the housing, so as to engage the forms 40 for the purpose of positioning and printing on the forms 40 as will become clear from a review of FIGS. 3, 4 and 5, which will now be explained.

Specifically, FIG. 3 shows the platen 84 in a low, or form-insertion, position in which a form 40, usually consisting of many layers, may be inserted between the movable driving rollers 106 and driven rollers 112 since in this low position there is a gap between the two pairs of rollers. While in this position, since the platen 84 does not engage any guide means, such as 126 and 128, and since there is a gap between the pairs of rollers, the forms 40 can easily be inserted therebetween. It should be explained here that the guide means 126 and 128 located on each side of the print head 14 provide the appropriate gap between the print head and the upper layer of the forms 40 to position the forms for proper thrust of the matrix wires and for clearance of the print head for movement thereover. Also, to provide a temporary grasp of the forms during operation of the terminal and movement of the platen assembly, the terminal is also provided with a holding means in the form of a metallic ball 130 appropriately mounted in a portion of the housing which is provided with a slot 132. Slot 132 being slightly larger than the ball unit, the metallic ball may react to gravity and engage the top surface of the forms and, through its own weight, simply hold the forms on the top surface of the work surface 16. The weight of the ball is sufficient to keep the forms intact when the forms are not being gripped by the rollers 106 and 112 or when the platen is not in printing position.

Note also, that in the lower or form insertion position, there is no gap between the hooks 80 and 88 which bottom against the platen ledges 82 and 92, the hooks being urged thereagainst by the resilient springs 94 and 96.

In the next or intermediate position, or form-advancing position, FIG. 4, the terminal, upon proper response to a request acting through suitable electronics, has rotated the shaft 36 and the cam 120 and urged the cam follower 122 against the return spring 126 and coil spring 114 so as to urge the driving rollers 106 against the stationary driven rollers, and thus grasp the form 40 therebetween with a yieldable force commensurate with the strength of the spring 114. That is to say, after initial engagement of the form 40 urging the latter against the stationary rollers 112, continued movement upward of the roller bail is prevented and yet the platen bail may move upward slightly so that the latter moves independently of the roller bail with the bias of the spring 114 being used to pressurize the forms 40. This, of course, is a function of the rise of the camming surface on cam 120. Notches 134 on the top of the platen bail arms 66, 68 provide the clearance so as to prevent interference between the rollers 106, shaft 102 and the arms of the platen bail. Too, since the rollers in this position are simply spring-biased against the underside of the forms, a variation in thickness is easily accomodated. In this position, the terminal, upon receiving the proper signal, may cause the drive rollers 106 to rotate and advance the forms without interference from the platen. Note that the springs 94 and 96 in this position of the bails are still holding the platen against the hooks 80 and 88, as in the first or form-insertion position above and that the form-holding means, including the metallic ball 130, are still operational.

When the form is properly positioned, through suitable electronics incorporated in the terminal, the cam 120 is again rotated urging the cam follower 122 further upwardly against the coil and return springs 114 and 126 and against the bias of the platen springs 94 and 96 whereupon the platen is urged against the bottom side of the forms. In this position, the form printing position, the platen is free of the hooks 80 and 88 so that the platen is essentially floating and can accommodate any longitudinal or transverse variation in the thickness of the forms. While in this position, the only pressure urging the platen against the forms is from the bias springs 94 and 96 and as clearly shown in FIG. 5, there is a gap between the hooks 80 and 88 and their respective ledges 82 and 92 in the platen. Also it is to be noted that the movement of the platen bail upwardly changes the amount of pressure of the driving roller against the forms only slightly since the additional extension of the coil spring 114 is only slight. In this position, the platen and the pressure rollers, being yieldably engaged against the form and with the top of the form being precisely positioned by the guides 126 and 128, the thickness of the form, be it one layer or several, and whether one side is folded or has a variation in its thickness side-to-side is immaterial in the matrix print head. Were it not for this floating aspect of the platen, it can be seen that the pressure would not be uniformly distributed against the bottom of the forms and the print head wires would not necessarily print easily through all the forms.

After the matrix print head is finished printing a line on the form and if it is desired to print one or more additional lines upon suitable signal from the electronics in the terminal, cam 120 is again rotated and the platen and roller bails are returned to position as disclosed in FIG. 3, to the intermediate positioning (FIG. 4) where the rollers in response to a suitable signal will move the forms 40 the required distance and then the platen is again positioned as in FIG. 5, all by actuation of the return springs 126 and the bail spring 114. This cyclical action can be repeated as often as required. It is also understood that there is suitable strobe means for forming columns of characters on the form commensurate with the rows suitable to print the appropriate indicia on the forms.

What is claimed is:

1. A platen assembly for holding one or more layers of record media at a predetermined position relative to a print head for printing characters on the record media including, (a) record media guide means positioned in a plane adjacent to the print head and effective to determine the position of the record media relative to the print head;

(b) a platen having a surface for co-operating with the print head;

(c) a platen bail mounting the platen for displacement to and from the printing position;

(d) means resiliently loading the platen with respect to the platen bail in the sense towards the printing positions;

(e) means resiliently biasing the platen bail away from the printing position;

(f) means for moving the platen bail against the resilient biasing thereof to advance the platen to the printing position;

(g) record media feed means for feeding the record media relative to the print head;

(h) support means for supporting the record media feed means for displacement to and from a printing position; and (i) means acting between the platen bail and the support means for the record media feed means for subjecting the support means to a biasing force acting relative to the platen bail and such as to urge the feed means towards its position for co-operation with the record media, and such that the platen bail and support means are movable in unison with respect to the record media and also separately of each other with respect to the record media whereby changes in the thickness of the record media are accommodated by changes in the displacements of platen bail and the support means.

2. A platen assembly as claimed in claim 1, and including means pivotally mounting the support means for movement about an axis extending transverse to the direction of advance of the record media to the print head, and means pivotally mounting the platen bail for pivotal movement about the same axis.

3. A platen assembly for holding one or more layers of record media at a predetermined position relative to a print head for printing characters on said record media comprising:

(a) guide means positioned on a plane adjacent to the print head and effective to determine the position of the record media relative to the print head, (b) record media feed means operable to feed the record media in a direction longitudinally of said plane and past the print head and guide means;

(c) support means for the record media feed means;

(d) means pivotally mounting the support means for pivotal movement about an axis transverse to said longitudinal direction;

(e) a platen having a planar surface for co-operating with the record media;

(f) a platen bail for mounting the platen;

(g) means acting between the platen and the platen head for resiliently biasing the platen in a direction towards the record media;

(h) pivot means for pivotally mounting the platen bail for pivotal movement about said axis;

(i) means resiliently biasing the platen bail so that the platen is normally displaced away from the location in which it is engageable with the record media, (j) means acting between the platen bail and the support means for the record media feed means for subjecting the support means to a biasing force acting relative to the platen bail and such as to urge the feed means towards its position for co-operation with the record media, and such that the platen bail and support means are movable in unison with respect to the record media and also separately of each other with respect to the record media; and (k) means for producing displacement of the platen bail against the resilient loading thereof to move the platen towards the record media, the displacement being of such extent that following co-operation of the platen with the record media any changes in thickness thereof are accommodated at the printing head by the resilient connection between the platen bail and the platen, and in the vicinity of the feeding means by the resilient loading of the feeding means support and the platen bail whereby changes in the thickness of the record media are accommodated by changes in the displacements of the platen bail and the support means.

* * * * *